US007303273B2

(12) United States Patent
Jurrens et al.

(10) Patent No.: US 7,303,273 B2
(45) Date of Patent: Dec. 4, 2007

(54) HEATED ROLL SYSTEM FOR DRYING PRINTED MEDIA

(75) Inventors: Jalme Grady Jurrens, San Diego, CA (US); Eric Lee Burch, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 186 days.

(21) Appl. No.: 10/679,607

(22) Filed: Oct. 6, 2003

(65) Prior Publication Data

US 2004/0066442 A1 Apr. 8, 2004

Related U.S. Application Data

(63) Continuation-in-part of application No. 10/066,064, filed on Jan. 31, 2002, now Pat. No. 6,679,599.

(51) Int. Cl.
*B41J 2/01* (2006.01)

(52) U.S. Cl. ..... 347/102; 347/101; 347/103

(58) Field of Classification Search ..... 347/101, 347/102, 103, 104; 156/555, 552, 540, 344, 156/247

See application file for complete search history.

(56) References Cited

U.S. PATENT DOCUMENTS 4,277,524 A 7/1981 Nkajima et al.
4,607,947 A 8/1986 Ensing et al.
4,833,530 A 5/1989 Kohashi
4,913,991 A * 4/1990 Chiba et al. ..... 430/45
5,249,024 A 9/1993 Menjo
5,296,904 A 3/1994 Jackson
5,428,384 A 6/1995 Richtsmeier et al.
5,438,435 A 8/1995 Lawniczak
5,520,763 A * 5/1996 Johnstone ..... 156/233
5,623,296 A 4/1997 Fujino et al.
5,645,888 A 7/1997 Titterington et al.
5,668,584 A 9/1997 Broder et al.
5,754,208 A 5/1998 Szlucha
5,886,727 A * 3/1999 Dobashi et al. ..... 347/213
5,927,189 A * 7/1999 Jones et al. ..... 101/23
6,089,703 A 7/2000 Pearson
6,508,551 B1 1/2003 Snyder
6,820,975 B2 * 11/2004 Sugaya et al. ..... 347/104
6,902,643 B2 * 6/2005 Arcaro et al. ..... 156/247
7,086,727 B2 * 8/2006 Nishikawa et al. ..... 347/102
2002/0027586 A1 * 3/2002 Kikuchi et al. ..... 347/104

* cited by examiner

*Primary Examiner*—Stephen Meier
*Assistant Examiner*—Leonard Liang

(57) ABSTRACT

A system and method for drying a printed medium includes a heated roll and a transport mechanism which moves the printed medium against the heated roll to dry the printed medium.

7 Claims, 5 Drawing Sheets

HEATED ROLL SYSTEM FOR DRYING PRINTED MEDIA

This Continuation-In-Part application claims the benefit of the utility application titled "HEATED ROLL SYSTEM FOR DRYING PRINTED MEDIA" (Ser. No. 10/066,064) filed on Jan. 31, 2002 now U.S. Pat. No. 6,679,599.

TECHNICAL FIELD

The present invention relates to inkjet printing, and more particularly to a method and system for drying a printed document.

BACKGROUND OF THE INVENTION

Inkjet printing has commonly been used for printing conventional documents, but is increasingly common in printing color photographs as well. Many inkjet printouts remain wet for several seconds, and even several minutes or hours, after printing, making them vulnerable to smearing. This relatively long drying time requires the printed medium to be handled carefully before it is completely dry to avoid damage.

SUMMARY OF THE INVENTION

Accordingly, the present invention is directed to a system for drying a printed medium, comprising a heated roll and a transport mechanism for moving the printed medium against the heated roll to dry the printed medium.

The invention is also directed to an inkjet printing mechanism having a system for drying a printed medium comprising a heated roll, a backing roll, and a transport mechanism for moving the printed medium between the heated roll and the backing roll to dry the printed medium.

The invention is further directed to a method for drying a printed medium, comprising the steps of disposing a heated roll in a medium transport path and transporting the printed medium along the medium transport path against the heated roll to dry the printed medium.

Further aspects and embodiments of the invention will be apparent from the description and claims set forth below.

DETAILED DESCRIPTION OF THE EMBODIMENTS

Figure 1:
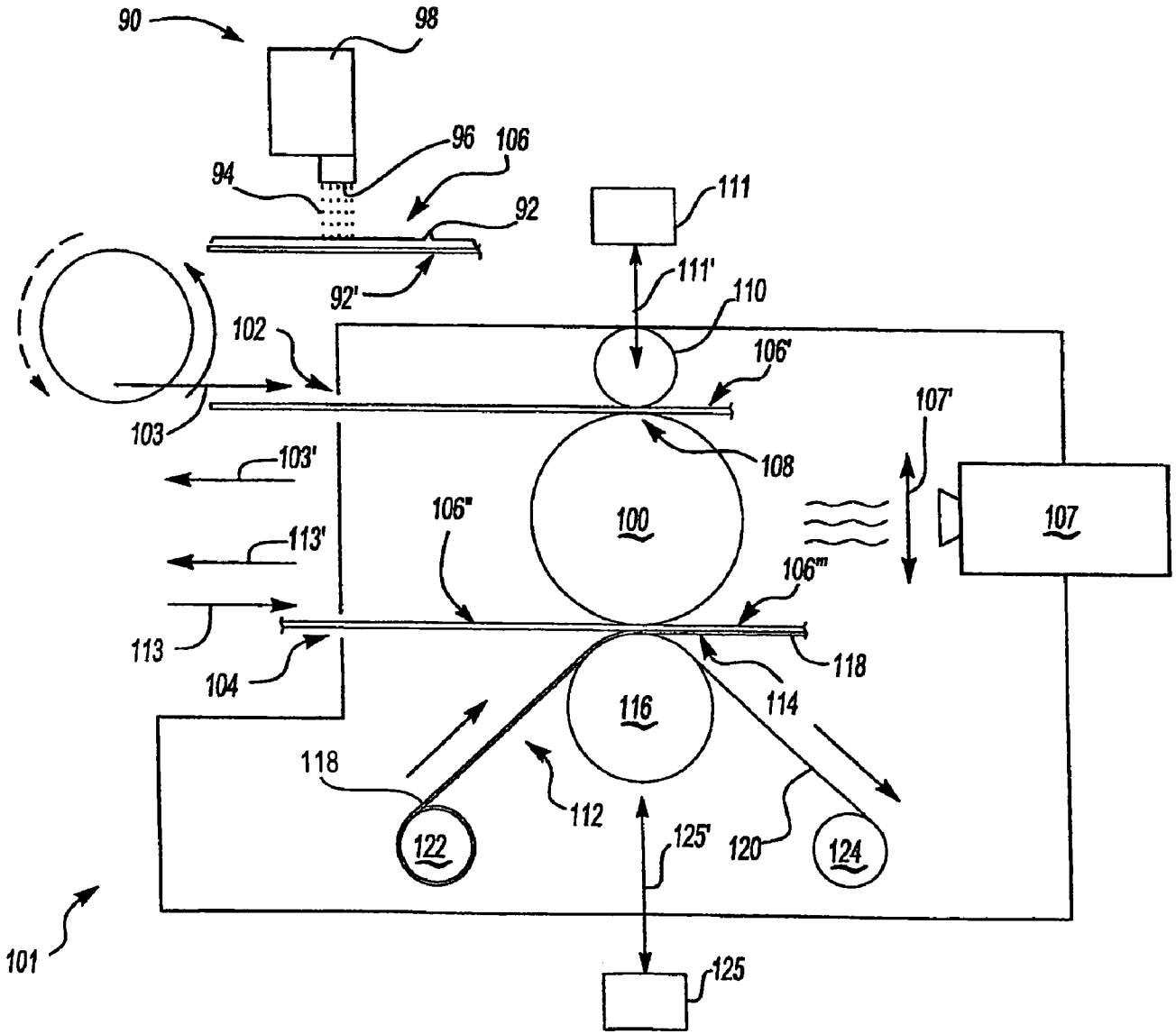
FIG. 1 is a representative diagram illustrating one embodiment of the inventive system.

To improve image quality, durability, and permanence, a thermal transfer overcoat ("TTO") is often applied as a laminate to printed inkjet media, such as plain office paper or photo media, although other medias may also be overcoated in some implementations, such as fabric media. However, the TTO should not be applied to the image until the ink is sufficiently dry; otherwise, the application process may compromise image quality. The ink drying time depends on both the type of media used in the printed document and the amount of ink saturation in the printed image. For some papers, such as plain office papers or porous photo media, the drying process occurs quickly enough to allow for almost immediate application of the TTO. But for other papers, such as swellable media, the ink will not be dry enough for TTO application on the order of minutes or even hours. Although it is possible to simply wait for the ink to dry before applying the TTO, the long drying period makes the total printing process slow and inconvenient for some users.

The illustrated embodiments of the invention generally involve using a heated roll 100 to dry printed media. Although the examples discussed below focus on drying inkjet printed media, the illustrated drying system may be incorporated into any printing system or method where a drying mechanism is desired.

The heated roll 100 may be made from any material having a high specific heat, such as a metal, to optimize heat retention and heat transfer to the printed medium. Fuser rolls, which may be similar to those used in laser printers, may be incorporated into an inkjet printing mechanism, such as printer 90, to carry out the drying process. A variety of different inkjet printing mechanisms may employ the system described herein, such as plotters, cameras, facsimile or multi-function hardcopy devices, as well as auxiliary devices for use in conjunction with such printing mechanisms, but for convenience, a printer 90 is illustrated and described. The illustrated printer 90 defines a printzone 92 in which ink 94 is selectively deposited by one or more printheads 96 of one or more inkjet cartridges 98. A variety of different suitable ink application systems are known to those skilled in the art, such as those employing reciprocating printheads which scan across the printzone 92 or those that are stationary during printing and span the entire printzone 92, known in the art as page-wide-array print bars, which for diagrammatic purposes may also be illustrated by cartridge 98. Other heated roll 100 characteristics, such as size, hardness and applied pressure, may be adjusted according to desired printing and drying characteristics and will be described in greater detail below.

FIGS. 1 through 5 illustrate possible system configurations 101, 200 and 300 respectively, incorporating the heated roll 100 for drying printed media. The systems 101, 200, 300 may use any known paper transport mechanism to move the paper along its paper path, such as drive roller systems or belt transport systems with or without a vacuum hold-down assist. FIG. 1 is a representative diagram of a system 101 that includes a drying slot 102 and a separate overcoating slot 104. In this example, a sheet of media 106 first receives a printed image in printzone 92. The backside 92' of the media 106 may either be a blank surface or a surface that has already been printed and dried. Following printing, the printed sheet 106 is first placed in the drying slot 102 and travels along a transport path 103 through a nip 108 formed between the heated roll 100 and a backing roll 110. Further, in this particular example, the sheet 106' travels through the nip 108 with its printed side against the heated roll 100 and its back side against the roll 110 so that the contact and heat from the heated roll 100 will dry the ink. Note that the printed side does not necessarily need to contact the heated roll 100 step and that the printed media may have any orientation that allows the heated roll 100 to dry the ink.

Moreover, in the various embodiments of the invention, one or more of the associated backing rolls may be heated or otherwise provide heat or energy to the printed media. Such heated backing roll may, for example and depending upon its placement in the configuration, assist with the drying of ink and/or with the attachment of an overcoat material.

Allowing the sheet 106' to travel along the transport path 103 through the nip 108 while the ink is still wet does create some risk of damaging the image, but the nip area and pressure in the nip 108 may be adjusted to accommodate different paper and ink characteristics to minimize this risk. For example, if the sheet contains a photographic image printed on swellable media, the desired nip characteristics would be different than if the sheet had simple text printed on conventional paper (e.g., simple text tends to be insensitive to nip characteristics) because photographic images, in general, are more saturated with ink and require a longer drying time than plain text.

In this and other embodiments, the area in the nip may be increased by increasing the roll pressure and/or decreasing the roll hardness. For example, vulcanized rubber may be used to decrease the roll hardness, while steel or another metal may be used to increase roll hardness. A larger nip area 108 distributes the pressure from the heated roll 100 over a greater surface area on the printed sheet 106'. At first glance, allowing contact between the heated roll 100 and the sheet 106' would appear to increase the likelihood that the image will be damaged during the drying process. However, the combined heat and pressure in the nip over a larger area actually promotes rapid drying and reduces or eliminates potential damage to the image for certain ink/paper types, which is an unexpected result.

Alternatively, increasing the heated roll 100 hardness and/or reducing the roll pressure using a pressure adjustment mechanism 111 that moves in the direction of vertical arrow 111' reduces the nip area, creating a system that is gentler to the printed sheet 106'. The system shown in FIG. 1 may even be constructed without the nip roll 110 to eliminate the nip altogether; in this case, the sheet 106' preferably travels through the drying slot 102 printzone side 92 up, with its back side 92' against the heated roll 100, allowing the sheet 106' to dry through heat absorption. Reducing or eliminating nip pressure on the sheet does reduce the risk of damage, but it also tends to increase drying time and also may potentially complicate the paper path when the drying system is incorporated into a printer. Alternatively, the nip roll 110 may be constructed as a series of star-wheel rollers mounted on a common shaft, similar to those used in the output path of some inkjet printing mechanisms.

Regardless of the specific nip characteristics, the heated roll 100 may be coated with a non-wetting material to further reduce possible damage to the image from the roll's surface. The non-wetting material may be, for example, a polyethylene, polypropylene, silcone rubber or Teflon(R). An optional heater or fan 107 may also be included to further aid the drying process. For instance, if the heater or fan 107 moved upwardly from the view of FIG. 1 as indicated by the vertical arrow 107', an air flow (heated or unheated) could be directed toward the nip 108 to assist in drying and/or removing moisture in the air adjacent the nip 108.

After the entire sheet has been dried by the heated roll 100, it may be ejected out of the drying slot 102 as indicated by arrow 103'. At this point, the dried sheet 106" should be dry enough for safe handling without damaging the printed image. If thermal transfer overcoat (TTO) material application is desired, the dried sheet 106" may be inserted into a separate overcoating slot 104, in the system 101 of FIG. 1 with its back (unprinted) side 92' preferably facing the heated roll 100. The dried sheet 106" and a TTO sheet 112 travel inwardly together along a second transport path 113 through a second nip 114 formed by the heated roll 100 and a second nip roll 116. Transport path 113' indicates the direction of travel for the sheet traveling back out or exiting through the second nip 104 following processing. The TTO sheet 112 used in this embodiment includes TTO material 118 disposed on a carrier substrate or backing layer 120 and is dispensed from a dispenser roll 122. The second nip roll 116 may be a conventional backing roll or a heated roll as long as the total amount of generated heat and the nip pressure is sufficient to melt the TTO material 118 away from the substrate 120 and deposit the overcoat 118 onto the printed side of the sheet 106, with the overcoated sheet then being indicated as 106'''. After the TTO material 118 is removed from the substrate 120, the empty substrate 120 may be rolled onto a take-up roll 124 for easy disposal.

As can be seen in FIG. 1, the second nip 114 presses the TTO composite sheet 112 and printed sheet 106" together. The heat from the heated roll 100 combined with the nip pressure releases the TTO coating 118 from the substrate 120 and fuses the TTO coating 118 to the printed side of the sheet 106", emerging as coated sheet 106'''. Once the combined heat and nip pressure fuses the TTO coating 118 to the image surface, preferably the second nip roll 116 moves away from the heated roll 100 under the power of a roll movement mechanism 125, shown schematically in FIG. 1 and which may be constructed as described above for mechanism 111, or using other movement mechanisms known in the art. Element 125' illustrates the direction of travel of nip roll 116 movement towards (and away from) the heated roll 100. This action then opens the second nip 114 and frees the coated sheet 106''' for ejection. In the configuration shown in FIG. 1, the same heated roll 100 dries the printed sheet 106' and fuses the TTO coating 118 onto the sheet 106", reducing the number of components in the system 101. Optionally, the fan or heater unit 107 may move downwardly to assist in the overcoating process.

Figure 2:
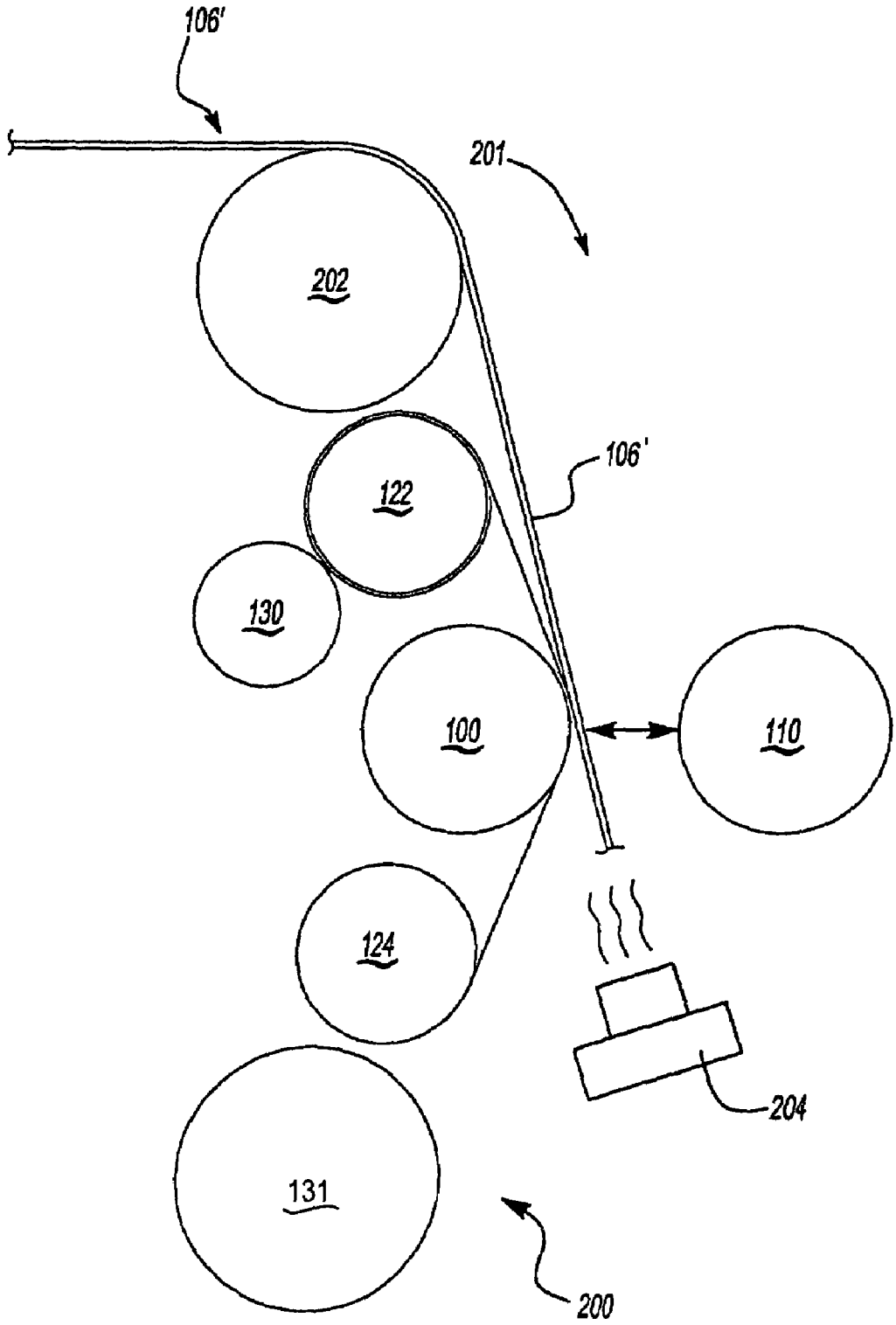
FIG. 2 is a representative diagram illustrating another embodiment of the inventive system during a drying process.
Figure 3:
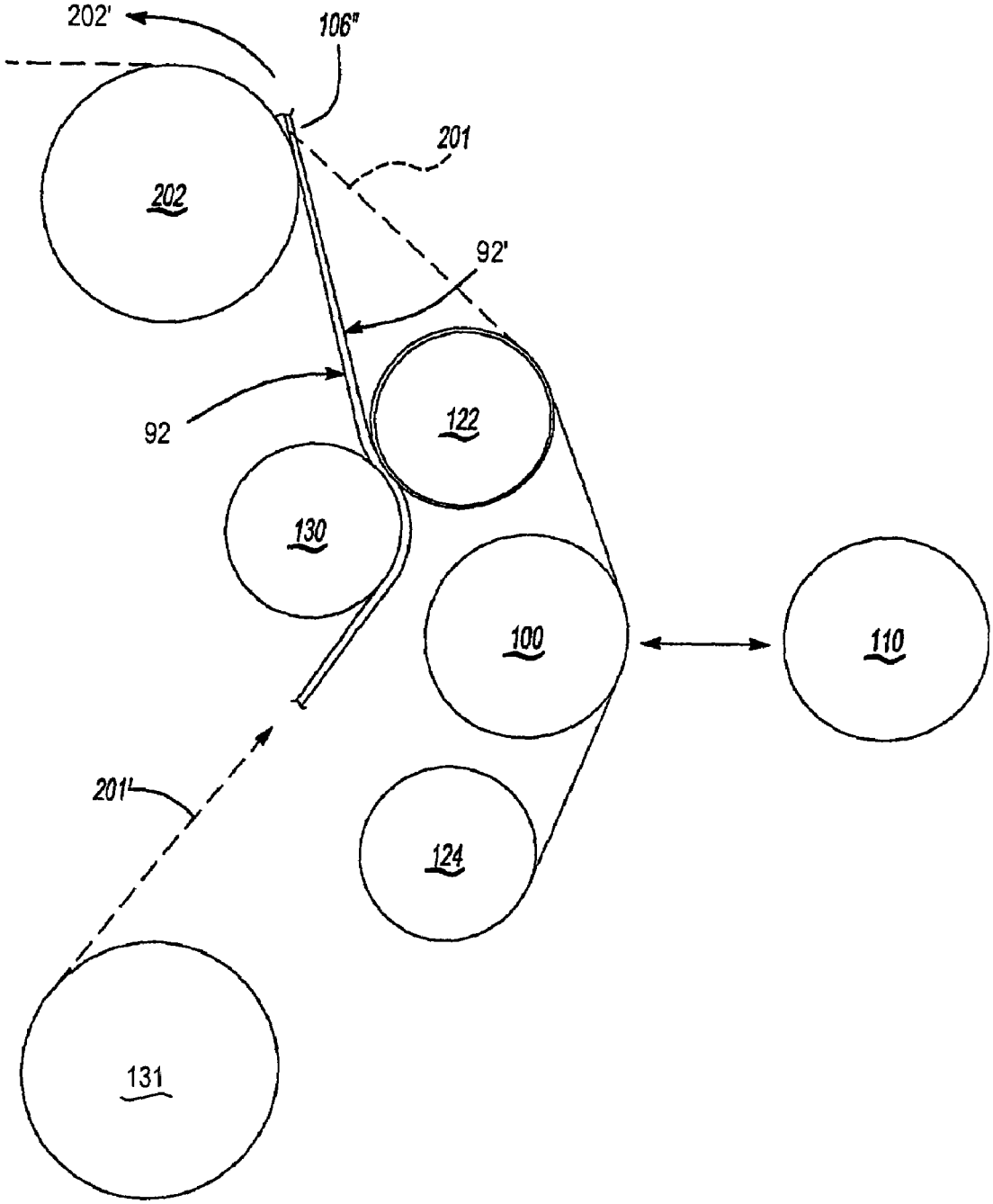
FIG. 3 is a representative diagram of the system shown in FIG. 2 during a repositioning process.
Figure 4:
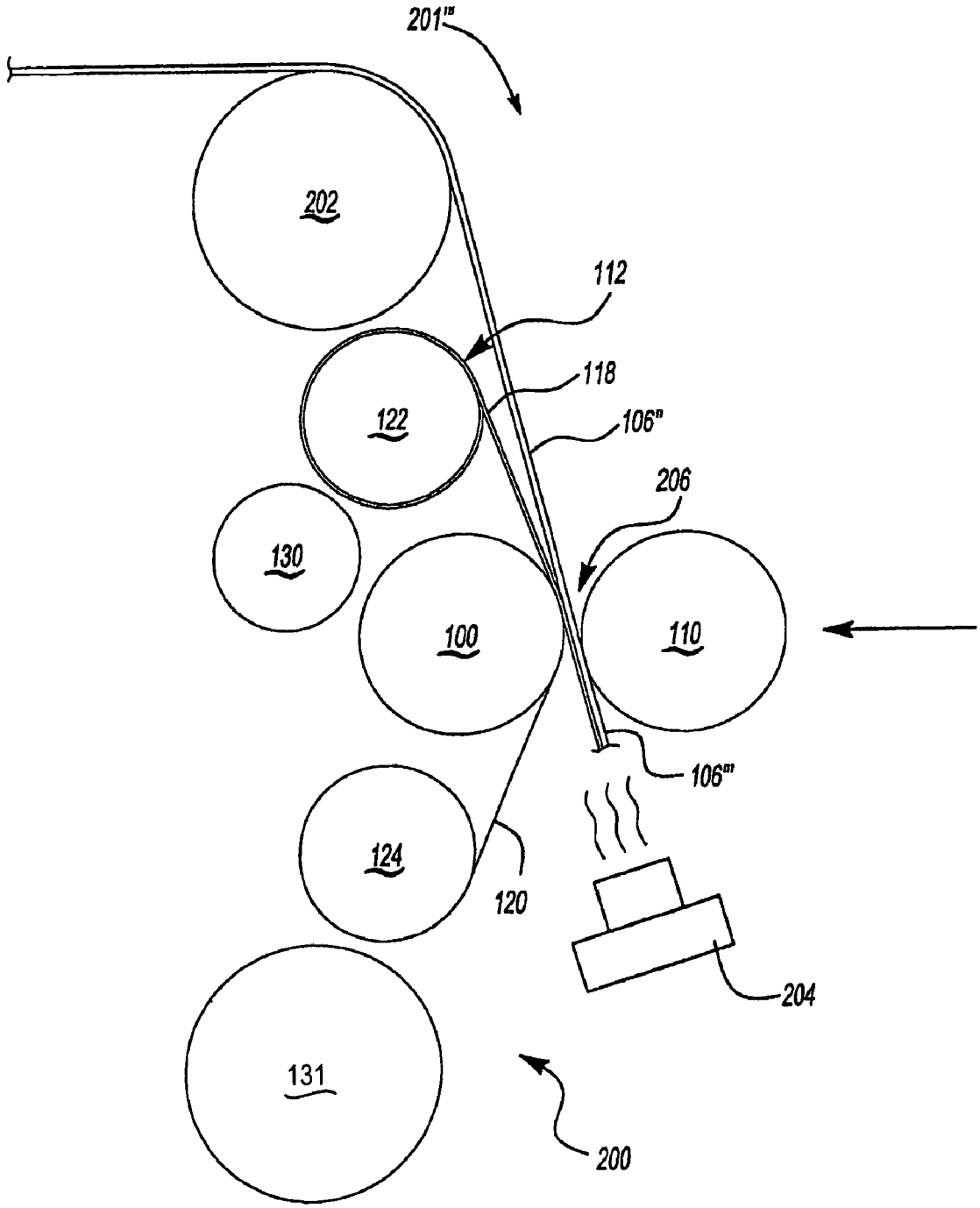
FIG. 4 is a representative diagram of the system shown in FIG. 2 during a fusing process.

As noted above, however, allowing contact between the freshly printed sheet 106 and the heated roll 100 may potentially damage the printed image because the roll 100 needs to touch the image before it is completely dry to complete the drying process. Because of this potential risk, the configuration shown in FIG. 1 may be more appropriate where a compact FIGS. 2 through 4 illustrate an alternative embodiment 200 where the drying process occurs without any contact between the heated roll 100 and the printed portion of the sheet 106'. This configuration may be used in cases where the paper and/or ink characteristics make early contact between the image and the heated roll 100 undesirable. In this embodiment, the sheet 106' passes between the same heated roll 100 and nip roll 110 twice, once to dry the image and once to apply the TTO 108. Of course, if the image does not require TTO application, the sheet 106' passes between the rolls 100, 110 only once to dry the image.

FIG. 2 illustrates the system configuration 200 during the drying step. The transport path 201 in this embodiment first passes the sheet 106 over the heated roll 100, with its back side 92' against the heated roll 100 and its printed side 92 facing the nip roll 110. Further, this embodiment incorporates a duplexer 202 that flips the printed sheet 106' between drying and coating steps, as will be explained in greater detail below. During this first pass, the nip roll 110 is spaced apart from the heated roll 100 50 that the printed surface does not contact any roll surface. In this embodiment, heat absorbed by the sheet 106' and heat convection surrounding the sheet 106' dries the printed surface on the sheet 106'. To improve convection and further decrease the drying time, an optional dryer 204, such as a fan, may circulate air near the space between the heated roll 100 and the nip roll 110. Once the sheet 106" is sufficiently dry, it may either be removed from the system 200 or recirculated through the system 200 for TTO application, as described below with respect to FIG. 3.

FIG. 3 illustrates a repositioning process that flips and positions the sheet 106" for TTO application. After the drying process shown in FIG. 2, the sheet 106" in this example is transported along a transport path 201' between a guide roll 130 and the duplexer 202 by way of a second guide roll 131, with the duplexer 202 further guiding the dried sheet 106" in the direction of transport arrow 201'. Element 202' illustrates a possible path of travel associated with duplexer 202. Note that the duplexer 202 can reposition the sheet 106" in ways other than that illustrated in FIG. 3. Once the entire sheet 106" clears the nip formed by the duplexer 202 and its associated guide roll 130, the printzone 92 will be facing the heated roll 100 during the TTO application process, as shown in FIG. 4. Although FIG. 3 illustrates one method for flipping the dried sheet 106", any duplexer can be incorporated into this embodiment to flip the sheet 106" in any manner.

FIG. 4 illustrates the system configuration of FIGS. 2 and 3 during the TTO application process. As shown in FIG. 3, the nip roll 110 and the heated roll 100 move closer to each other to form a nip 206 through which both the dried printed sheet 106" and the TTO sheet 112 travel. Before starting the second pass over the heated roll 100, the printed sheet 106" is inverted using any known paper-flipping mechanism so that the printed side 92, rather than the back side 92', faces the heated roll 100. This arrangement allows the TTO material 118 to contact the printed side of the sheet 106" (the printzone 92) in the nip 206. As the TTO sheet 112 and the printed sheet 106" pass through the nip 206 together along a transport path 201''', the nip pressure and heat releases the TTO material 118 from its supporting substrate 120 and fuses the TTO material 118 onto the printed side 92 of the sheet 106", resulting in coated sheet 106'''. Like the configuration shown in FIG. 1, the TTO sheet 112 may be unrolled from a dispensing roll 122 and the bare substrate 120 rolled into a take-up roll 124 for easy disposal. Once the TTO material 118 is fused onto the printed side of the sheet 106", the coated sheet 106''' is ready to be removed from the system 200.

Because the printed sheet 106' passes through the same system 200 for both the drying and the TTO application process, a user does not have to reinsert the sheet 106' into the system through two different slots as is required in the embodiment shown in FIG. 1. The embodiment shown in FIGS. 2, 3 and 4 allows the sheet 106' to travel the same transport path 201 twice, decreasing the number of pages that may be printed, dried and coated per minute as well. Further, drying the sheet 106' without allowing contact between the printzone 92 and the heated roll 100 tends to increase drying time, decreasing the page per minute rate even further. Despite these potential disadvantages, the lack of contact between the heated roll 100 and the freshly-printed image greatly reduces the risk of image damage and ensures consistent, high-quality TTO coated images in applications where image quality is a higher priority than print speed and minimized system size.

Figure 5:
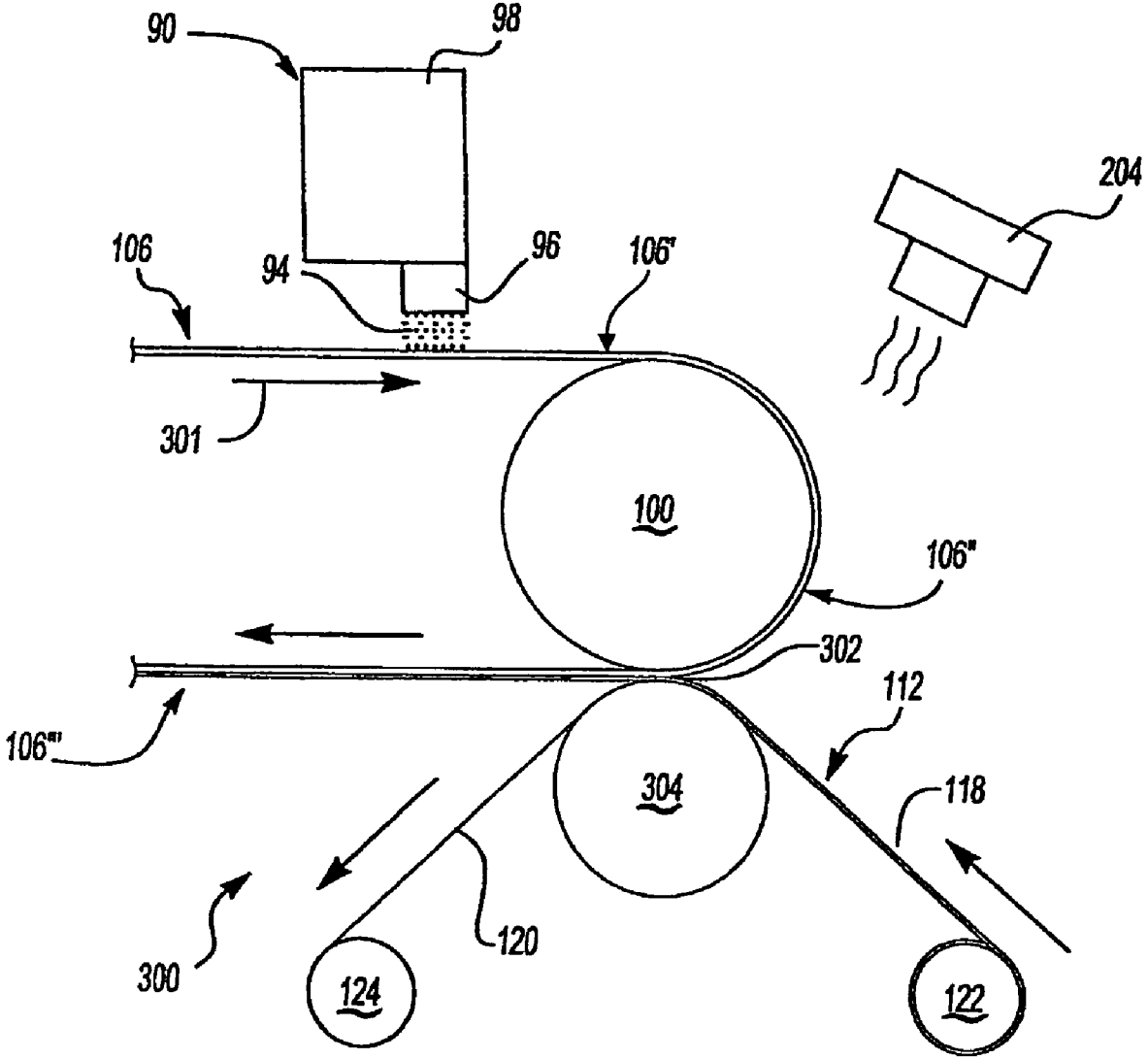
FIG. 5 illustrates yet another embodiment of the inventive system.

The configuration 300 shown in FIG. 5 optimizes both printing speed and reduced space. In this embodiment, the sheet 106 is printed by the printer 90 as shown in the Figure. The printed sheet 106' then travels along the transport path 301 over the heated roll 100 with its back surface 92' against the heated roll 100 to dry the printed image. An optional fan or a supplemental heater 204 disposed near the heated roll 100 circulates air around the sheet 106' to improve drying efficiency. Because the system 300 in FIG. 5 transports the dried printed sheet 106" only about halfway around the heated roll 100 before TTO application begins, the fan or heater 204 ensures that the sheet 106" is dry enough to prevent the TTO application process from damaging the printed image.

During TTO application, the dried printed sheet 106" continues to travel along the transport path 301, without retracing any previous path portions, through a nip 302 formed by the heated roll 100 and a second heated roll 304. The TTO medium 112 is also trapped between the two heated rolls 100, 304, causing the TTO material 118 to melt away from the substrate 120 and fuse to the printed side 92 of the sheet 106". As in the other embodiments, the TTO material 118 may be dispensed from a dispensing roll 122 and the substrate may be collected onto a take-up roll 124. The coated sheet 106''' may then continue along its transport path until it is ejected from the system 300. The dual functionality of the heater roll 100 and the continuous paper path in this embodiment provides a compact system design that dries and coats sheets quickly.

Note that any roll combination may be used in the inventive system 101, 200, 300 as long as it contains at least one heated roll 100. For example, the system 101, 200, 300 may incorporate two heated rolls to form the nip, thereby heating the printed sheet 106' simultaneously on its printed side 92 and its back side 92' to increase drying efficiency. Using two heated rolls also facilitates melting and transfer of the TTO material onto the printed and dried sheet 106". The residual heat from the drying process also helps improve TTO application. Also, although the illustrated embodiments show systems acting as both a dryer and a fuser, the TTO sheet 112 may be omitted from these embodiments to operate the system as a dryer only.

Allowing the heated roll 100 to contact the wet image surface without damaging the image is an unexpected result of the invention. Further, using the heated roll 100 in an inkjet printer is a novel approach to drying inkjet printed images because heated rolls 100 are normally used as fuser rolls in laser printers. In one embodiment, incorporating a laser printer fuser roll into an inkjet printer as a dryer roll uses an existing component in a novel manner.

The optimum parameters for the wait time between printing and fusing, the amount of nip pressure, transport speed through the system, and the heated roll temperatures for drying and fusing may all be varied to ensure that the system dries and coats printed media without compromising print quality. Experimental results have shown that a heated roll temperature between 90° C. and 160° C. dries the printed media without damaging image quality. The delay between the printing and the overcoating steps also affects the final print image quality; during testing, a 10 second delay tended to smear most images, while a 20 second delay resulted in varying print quality. A wait time of 40-60 seconds virtually eliminated smearing, although there was dye migration in some cases. The optimum parameters may be different in different printing systems, for differing amounts of ink laid on the sheet 106 and for different media, and these specific parameters can be deduced by those of skill in the art without undue experimentation.

As a result, the invention leverages a fuser assembly, which is normally used in laser printers, into a drying system for drying an inkjet-printed document. The invention also may use the fuser assembly to apply the TTO overcoat, providing an efficient way to apply the overcoat to slow-drying print media without adding a separate heating and drying element to the printer. Even though the heated roll 100 contacts the printed image while it is still wet, the invention unexpectedly decreases the image drying time without damaging the image. The inventive system may be incorporated into existing print engine mechanisms to lower the cost and complexity of the TTO engine and the drying engine. Further, by using the same nip to both dry the printed image and to fuse the TTO material 118, as shown in FIGS. 2, 3, and 4, the system simplifies the paper transport path and keeps the system relatively compact.

Note that any of the embodiments described may be used solely as a dryer or as a fuser without departing from the scope of the invention. For example, the invention may be used to apply TTO material to a document printed by a different printer, or even printed using a system other than an inkjet system. It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A printing device comprising:

a heated roll;

a backing roll;

a transport mechanism that moves a printed medium against the heated roll, a printed side of the printed medium facing away from the heated roll during a first pass of the printed medium against the heated roll, the heated roll and the backing roll being spaced apart during the first pass;

an inverting mechanism that inverts the printed medium; and a means for supplying a separate sheet to the heated roll;

wherein the transport mechanism moves the inverted printed medium for a second pass against the heated roll, the printed side of the inverted printed medium facing the heated roll during the second pass, the heated roll and the backing roll forming a nip during the second pass such that the inverted printed medium passes through the nip and the separate sheet is fused to the printed side of the printed medium.

2. A device as recited in claim 1, wherein the backing roll is heated or otherwise provides energy or heat.

3. A device as recited in claim 1, wherein the separate sheet is a thermal transfer overcoat sheet, laminate, film sheet, or substantially continuous web.

4. A device as recited in claim 1, wherein the inverting mechanism includes a duplexer.

5. A device as recited in claim 1, wherein the backing roll is not heated.

6. A device as recited in claim 1, wherein the heated roll is coated with a non-wetting material.

7. A device as recited in claim 1, wherein the printed side of the printed medium includes printed ink, and wherein the printed medium does not thermally contact the heated roll prior to application of the printed ink to the printed medium.

* * * * *

UNITED STATES PATENT AND TRADEMARK OFFICE

CERTIFICATE OF CORRECTION

PATENT NO. : 7,303,273 B2
APPLICATION NO. : 10/679607
DATED : December 4, 2007
INVENTOR(S) : Jalme Grady Jurrens et al.

It is certified that error appears in the above-identified patent and that said Letters Patent is hereby corrected as shown below:

In column 4, line 65, delete “50” and insert -- so --, therefor.

In column 5, line 15, after “transport” insert -- path --.

Signed and Sealed this

Fifth Day of August, 2008

JON W. DUDAS
*Director of the United States Patent and Trademark Office*